US006497452B2

(12) United States Patent
Catelli

(10) Patent No.: US 6,497,452 B2
(45) Date of Patent: Dec. 24, 2002

(54) HIGH-CHAIR WITH TRAY PROVIDED WITH REMOVABLE COVER ELEMENT

(75) Inventor: Pietro Catelli, Como (IT)

(73) Assignee: Artsana, S.p.A., Grandate (IT)

( * ) Notice: Subject to any disclaimer, the term of this patent is extended or adjusted under 35 U.S.C. 154(b) by 0 days.

(21) Appl. No.: 09/882,995

(22) Filed: Jun. 14, 2001

(65) Prior Publication Data

US 2002/0060480 A1 May 23, 2002

(30) Foreign Application Priority Data

Nov. 17, 2000 (IT) ..... MI000661 U

(51) Int. Cl.[7] ..... A47B 39/00
(52) U.S. Cl. ..... 297/153; 297/148; 297/188.01
(58) Field of Search ..... 297/148, 149, 297/150, 151, 153, 154, 184.13, 188.01, 188.18, 188.2, 219.12, 224; 108/90

(56) References Cited

U.S. PATENT DOCUMENTS 1,135,269 A * 4/1915 Dudley ..... 108/90
1,738,429 A * 12/1929 Heyman ..... 108/90 X
2,572,333 A * 10/1951 Greitzer ..... 108/90
2,684,110 A * 7/1954 Stone ..... 297/154
3,345,105 A * 10/1967 Levy et al. ..... 297/149 X
3,512,297 A * 5/1970 D'Athis Malherbe et al. ... 297/148 X
3,729,037 A * 4/1973 Dare et al. ..... 297/148 X
4,165,123 A * 8/1979 Hutson ..... 297/153
4,606,576 A * 8/1986 Jones ..... 297/153
5,294,172 A * 3/1994 Dubus ..... 297/148
5,810,432 A * 9/1998 Haut et al. ..... 297/153

* cited by examiner

*Primary Examiner*—Laurie K. Cranmer
(74) *Attorney, Agent, or Firm*—Steinberg & Raskin, P.C.

(57) ABSTRACT

A high-chair (1) comprises a seat (3), a frame (2) and a tray (4) associated with the seat (3) or the frame (2), said tray (4) presenting a perimetral edge (6) and a surface (7) bounded by said edge. There is provided, removably associable with said tray (4), a cover element (8) having a shape complementary to this latter and arranged to cover at least the surface (7) of said tray (4), said cover element (8) being able to support containers of liquids or foods to be administered to a child seated on the seat (3)

10 Claims, 7 Drawing Sheets

HIGH-CHAIR WITH TRAY PROVIDED WITH REMOVABLE COVER ELEMENT

FIELD OF THE INVENTION

The present invention relates to a high-chair and in particular to a high-chair having a removable cover element.

BACKGROUND OF THE INVENTION

A high-chair is known to comprise a tray on which toys can be placed or on which a container can be positioned holding a food to be administered to the child (such as a plate with a meal or a beaker of water). With such a high-chair, if the food escapes from the container it falls onto the tray which then has to be cleaned, this not always being easy to accomplish.

Moreover, if the high-chair and tray are of wooden construction, any escape of the food C from the container can result in this food (for example liquid) penetrating into interstices in the tray, for example along its (usually raised) edge, with obvious cleaning difficulties.

High-chair trays are also known which already present toys on their surface; with such trays it is dangerous and/or problematic to place a food container on them as this may be supported unstably on the tray (because of the toys), leading to obvious problems.

OBJECTS AND SUMMARY OF THE INVENTION

An object of the present invention is to provide a high-chair which is improved compared with known high-chairs.

A particular object of the invention is to provide a high-chair the tray of which can provide protection against escape of the child's food from the respective container.

A further object is to provide a high-chair the tray of which can be provided with toys, while at the same time being able to be easily and safely used to support containers for foods to be offered to the child seated on the high-chair.

A further object is to provide a high-chair which enables containers of food for the child to be easily positioned on its tray.

These and further objects which will be apparent to the expert of the art are attained by a high-chair in accordance with the accompanying claims.

BRIEF DESCRIPTION OF THE DRAWINGS

The present invention will be more apparent from accompanying drawing, which is provided by way of non-limting example and in which.

DETAILED DESCRIPTION OF THE INVENTION

Figure 1:
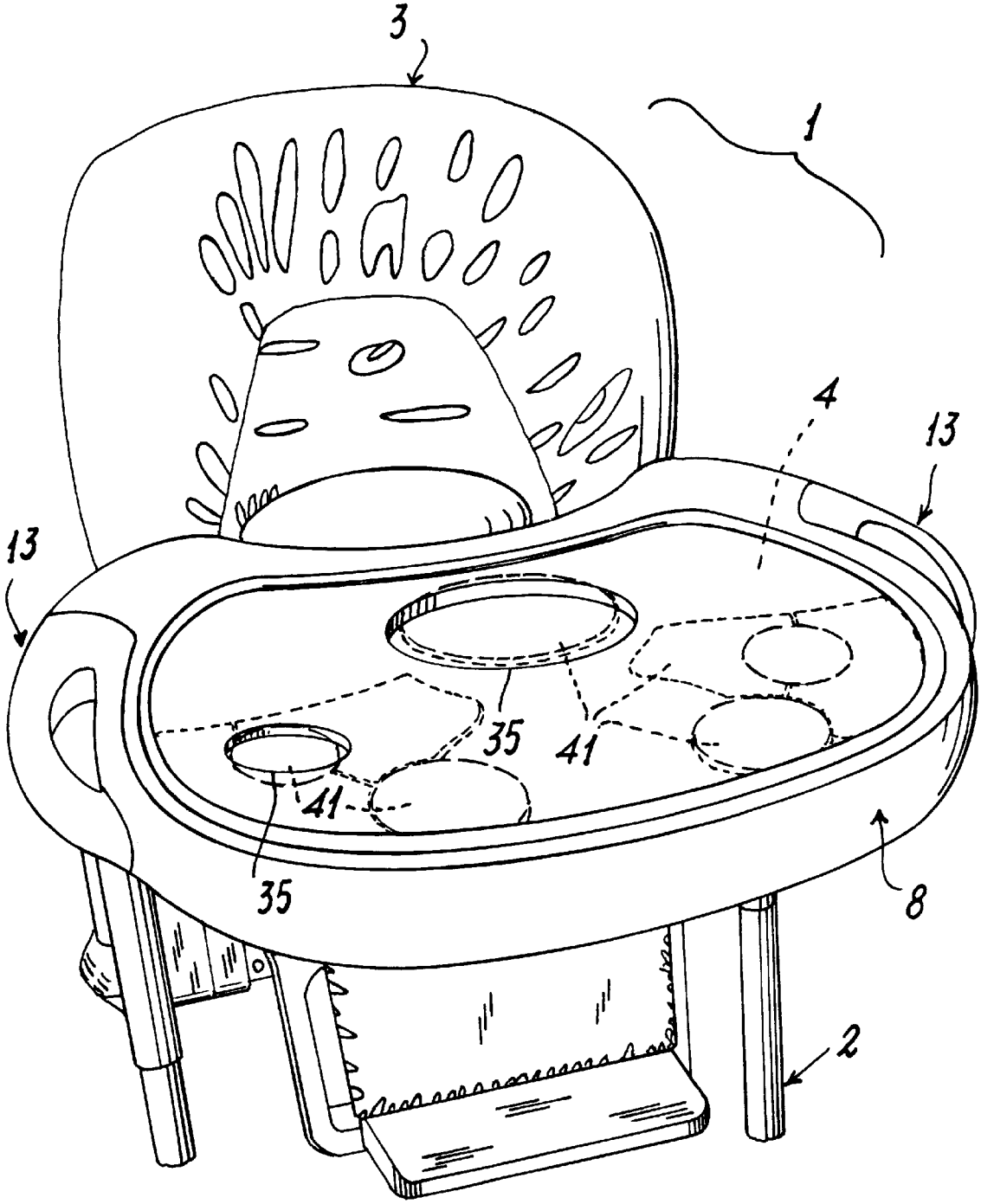
FIG. 1 a partial view of a high-chair according to the invention presenting a tray covered with a removable cover element.
Figure 2:
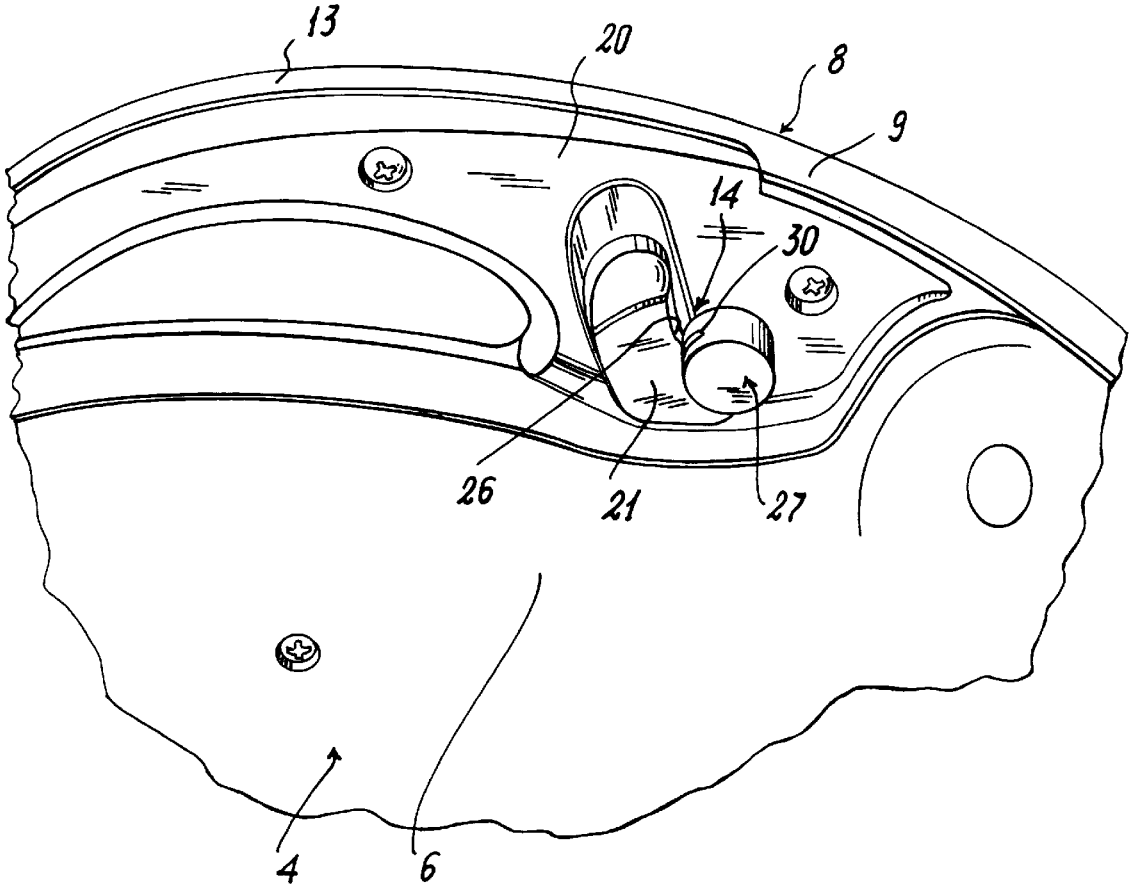
FIG. 2 is a partial view from below of the tray of the high-chair of FIG. 1.
Figure 3:
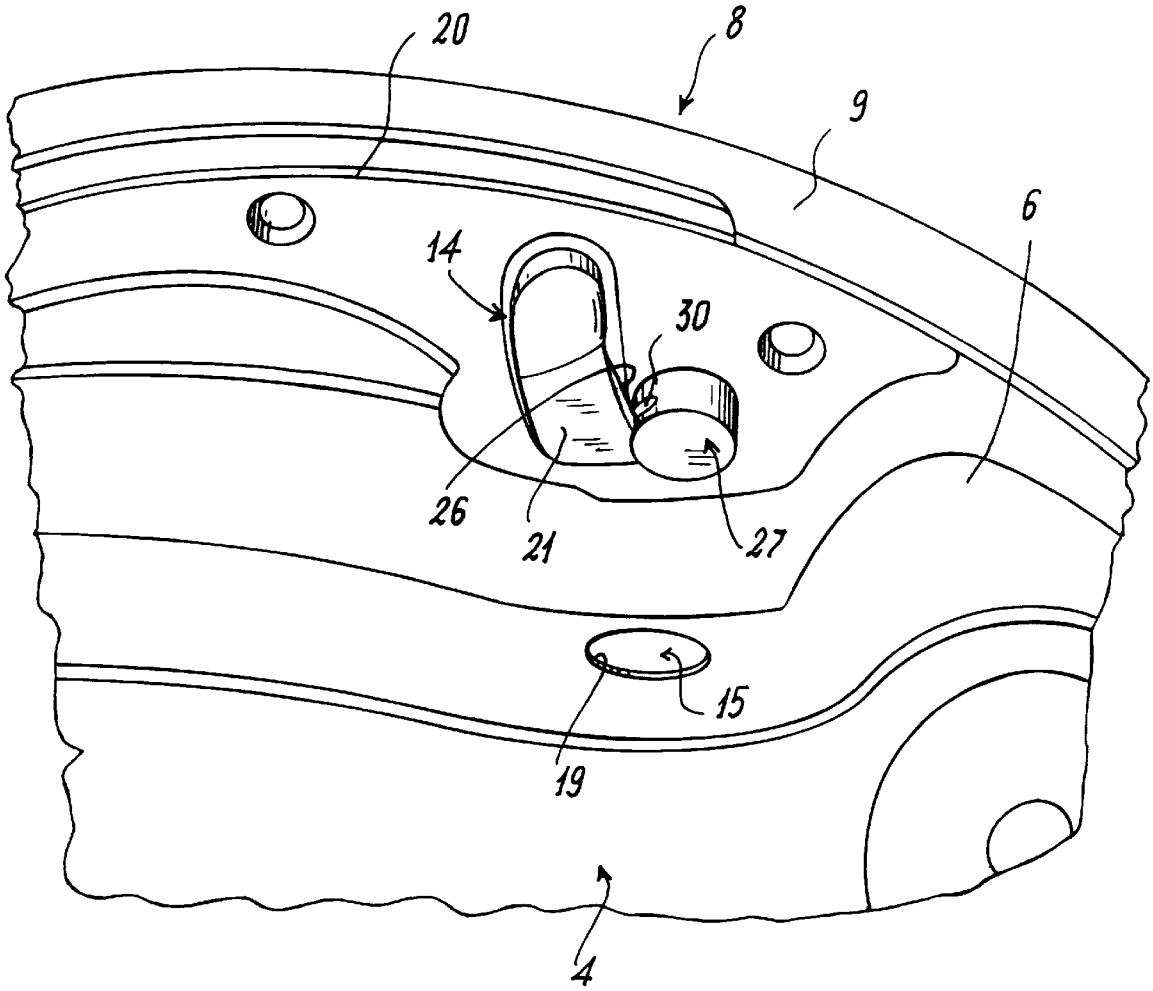
FIG. 3 is a view similar to that of FIG. 2, but shown during the removal of the tray cover element from the tray.

With reference to said figures, these show a high-chair 1 comprising a frame 2 supporting a usual seat 3. A tray 4 is also provided (associated with the frame, as in the example shown in the figures, or with the seat 3) having a perimetral edge 6 and a surface 7 bounded by said edge.

According to the invention, with the tray 4 there is associated a removable cover element 8 having preferably a shape complementary to the entire tray 4. This element 8 therefore comprises a rim 9 to be superposed on the edge 6 of the tray, and a substantially flat surface 10 without any additions, which is bounded by said rim and is to be superposed on the surface 7 of the shelf From said rim 9 there project, laterally to the element 8, two handles or gripping members 13 preferably integral with the cover element. On the lower side of this latter, in a position corresponding with at least one of said handles 13, there is present a hooking member 14 to cooperate with a counter-member 15 associated laterally with the tray 4. The purpose of this is to secure the cover element 8 to the tray.

More particularly, each hooking member 14 comprises a slider 17 provided with an end 18 arranged to cooperate with a recess or seat 19 acting as the hooking counter-member 15. This slider is partially inserted into a portion 20 of the element 8 to cooperate with an operating slide button 21 slidable on said portion 20. This slide button is coupled to the slider 17 by a pin 21 A slidable within a slot 22 provided in said portion 20. The slider moves against a spring 23 positioned in the interior of the portion 20 and resting against a fixed part of this latter.

Figure 4:
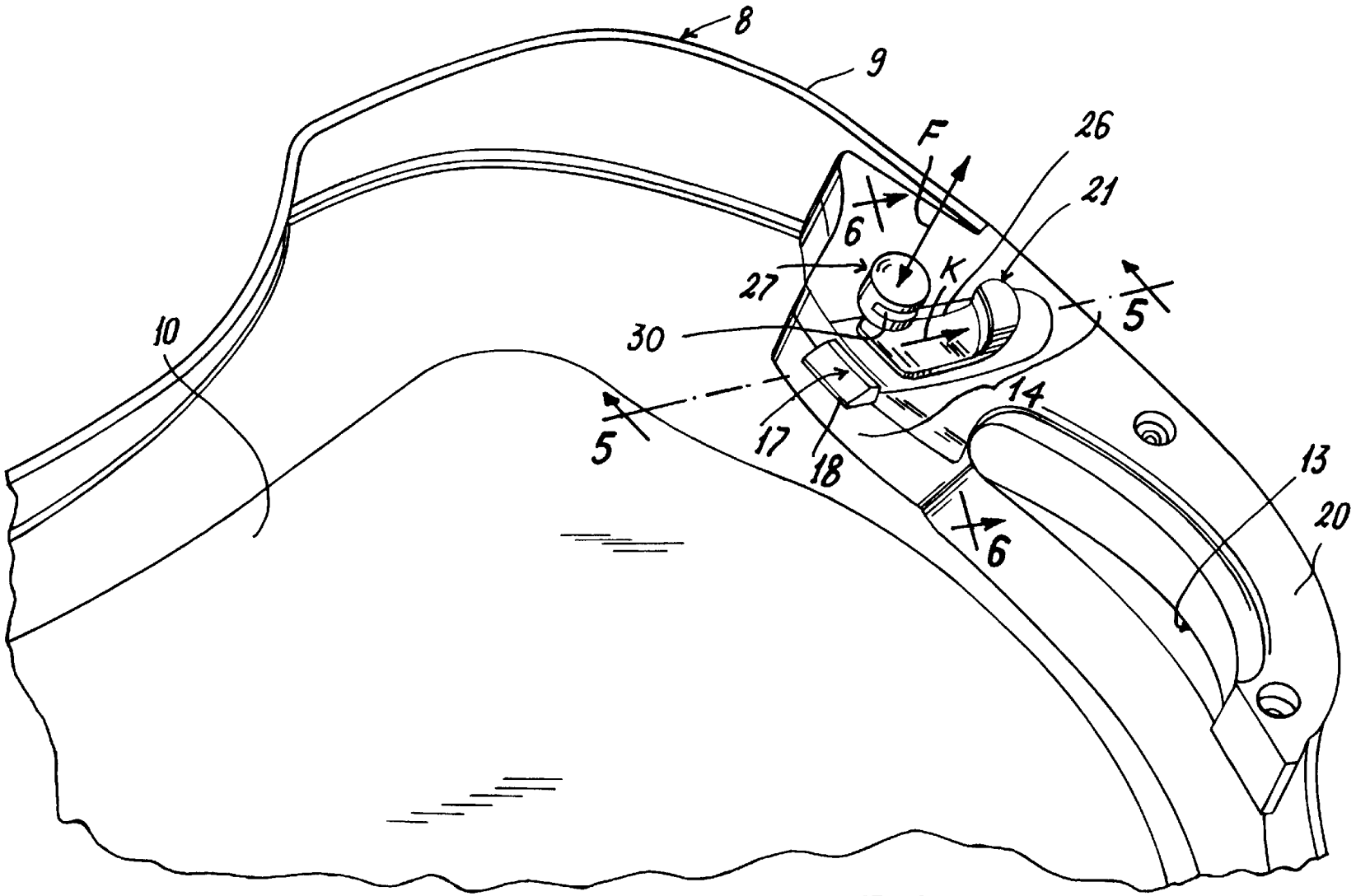
FIG. 4 is a partial view from below of a part of the tray of FIG. 1.
Figure 5:
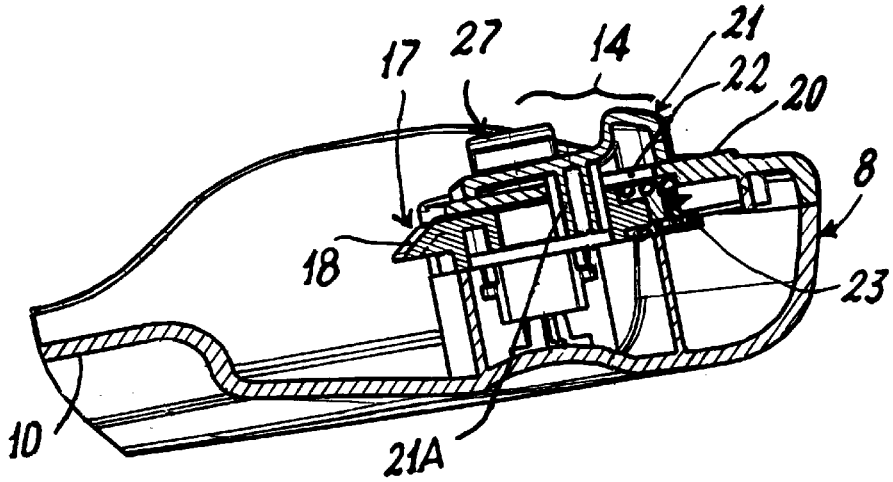
FIG. 5 is a section on the line 5—5 of FIG. 4.
Figure 6:
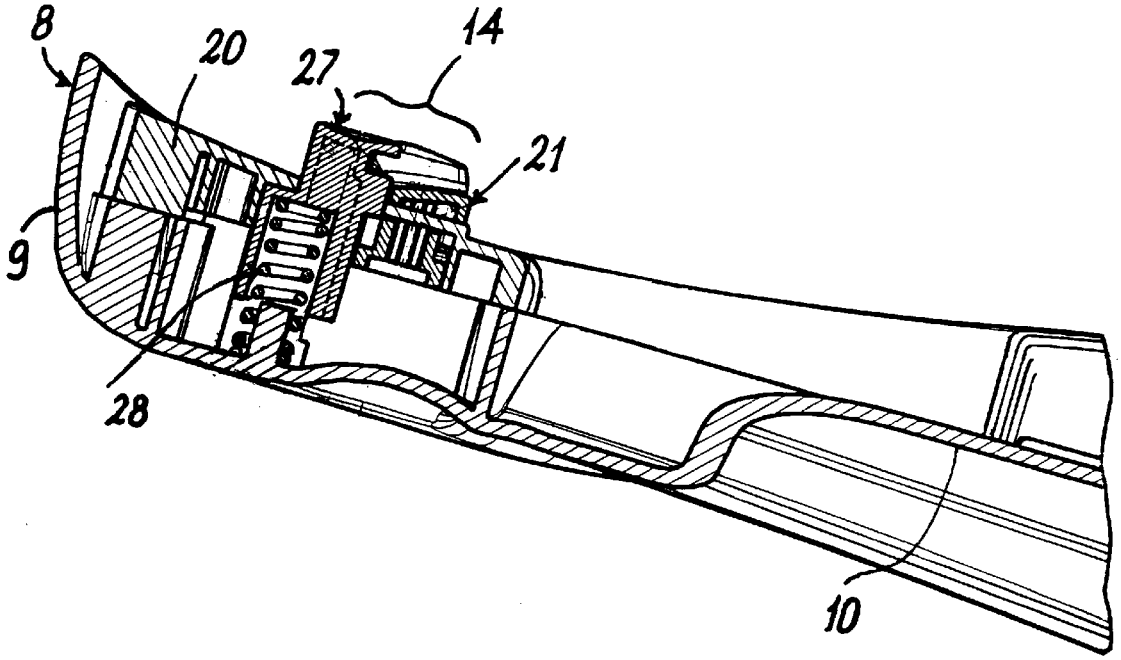
FIG. 6 is a section on the line 6—6 of FIG. 4.

The slide button 21 presents a curved edge 26 arranged to cooperate with a pushbutton or member 27 for blocking the movement of the slide button 21 associated with the portion 20. This locking member is movable, against a spring 28 contained in the portion 20, in a direction perpendicular to the direction of movement of the slide button 21; these directions are indicated by the arrows F and K of FIG. 4. The locking member 27 has a cylindrical body, in the side of which there is provided a slot 30 for receiving the slide button 21 when it is moved to enable the cover element 8 to be removed from the tray 4.

In this respect, when the tray 4 is covered by the element 8, the end 18 of the slider 17 of each hooking member 14 is positioned in the seat 19 of the tray 4. This element is hence secured to the tray 4. In this position the locking member 27 presents its slot 30 raised above the edge 26 of the slide button 21. The movement of this latter in the direction of the arrow K is hence blocked by the body of the member 27.

If the cover element 8 is to be removed from the tray 4, the member 27 has to be pressed towards the tray against the spring 28. In this manner the slot 30 is brought into the same plane as the edge of the slide button 21; by maintaining the member 27 in this position, the slide button can be moved in the direction of the arrow K of FIG. 4, to extract the end 18 of the slider 17 from the seat 19. By lifting the element 8 by means of the handles 13, this element can be removed from the tray 4.

in this manner the cover element 8 can be used as a portable tray for carrying one or more food containers (for example a plate and a beaker) onto the tray 4 after the child has been seated on the seat 31. This is achieved in total safety and comfort.

To achieve safe transport of these containers with stable support on the element 8, this latter can present one or more recessed parts 35 for a beaker and/or for a plate.

Advantageously, the element 8 is transparent. This enables toys or publications to be maintained on the underlying tray 4 to attract the attention of the child while eating.

Figure 7:
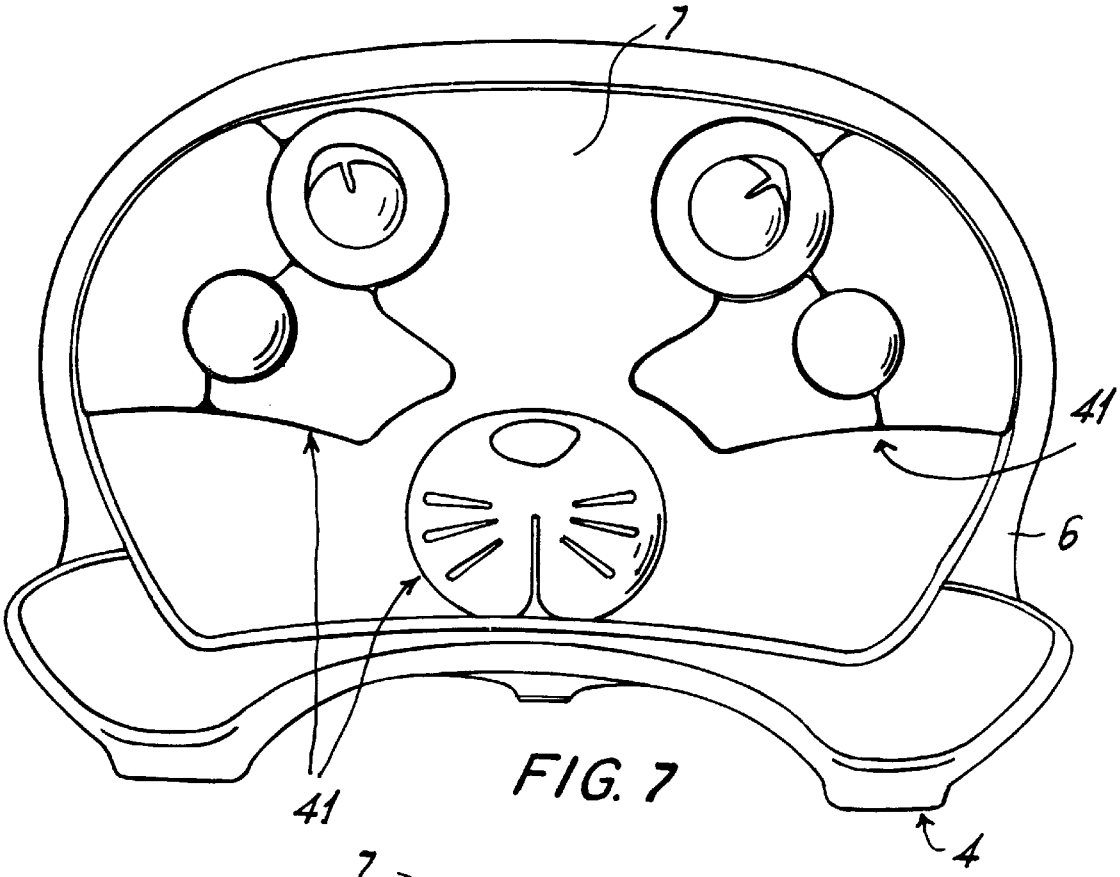
FIG. 7 is a view from above of a high-chair tray of the invention provided with toys.
Figure 8:
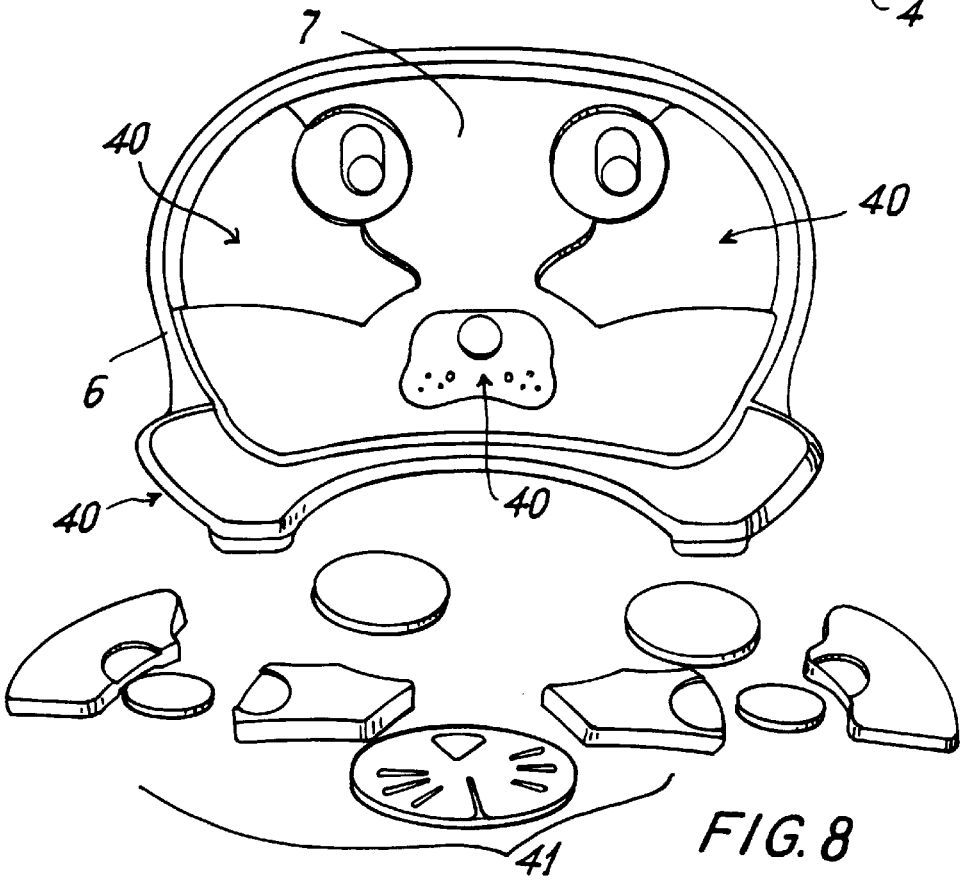
FIG. 8 is a view of the tray of FIG. 7 from above with the toys removed from it.
Figure 9:
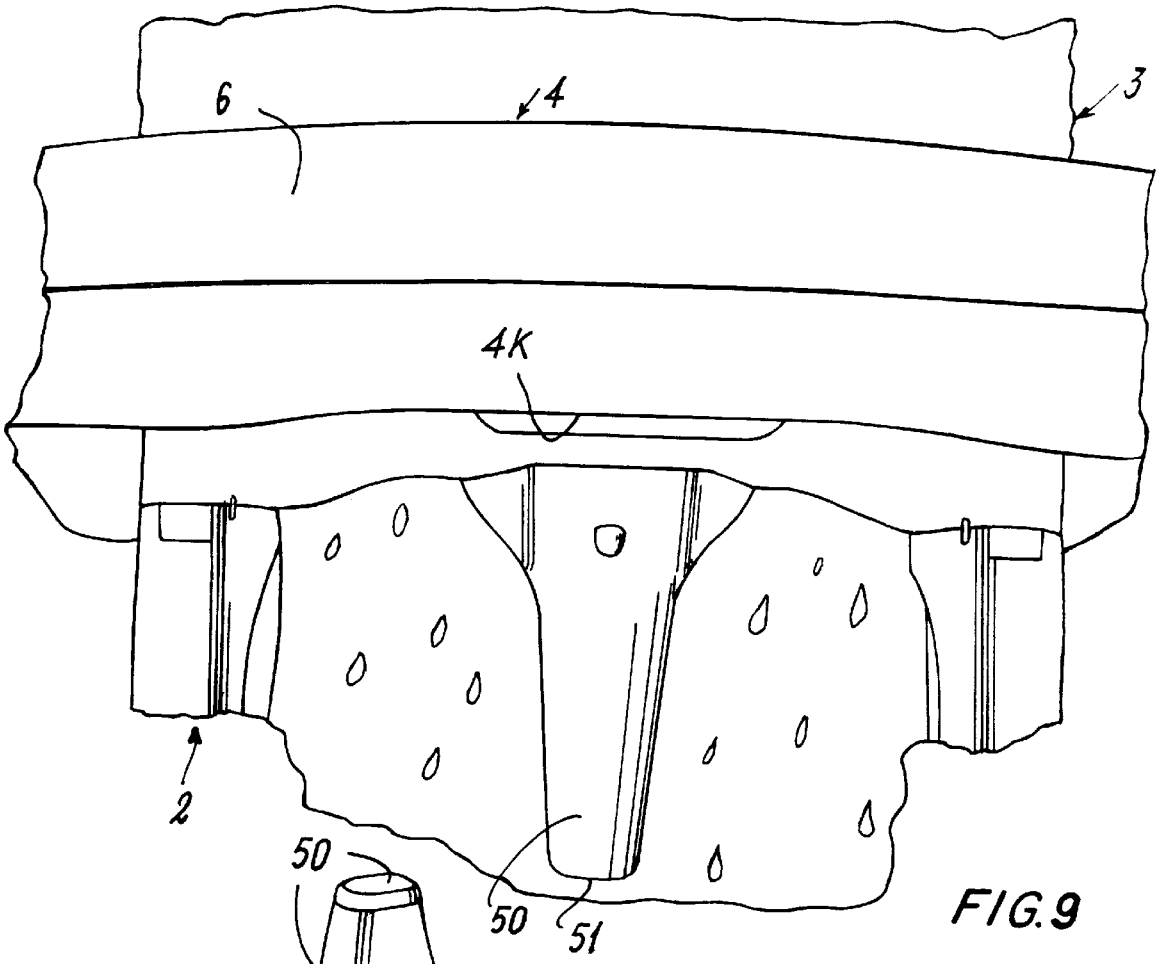
FIG. 9 is a partial front view of the tray of FIG. 7.
Figure 10:
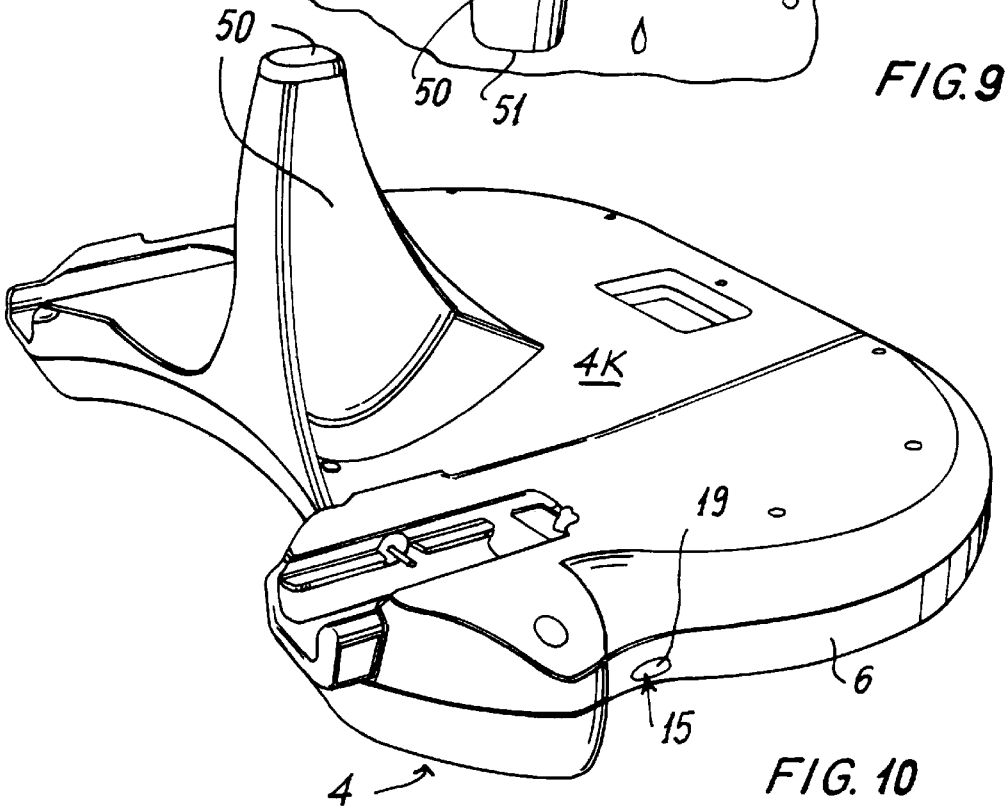
FIG. 10 is a perspective view of the tray of FIG. 7 from below.

In this respect, the tray 4 can be of the type provided with seats 40 for receiving elements 41 which can be assembled to define built-up images (for example to create animal images or faces, for example of a cat as shown in FIG. 7). These elements present recesses such as to associate the built-up image with an image known to the child. The seats 40 can also present reliefs 42 or recesses of different depths such that the elements 41 can be easily fitted in and remain fitted.

The aforesaid images are visible to the child even when the tray 4 is covered by the element 8. This latter also prevents liquids or the like which spill from containers positioned on them being able to fall onto the tray 4 and onto the elements 41 positioned on them; the element 8 also enables the child to be fed without removing the toys (elements 41) or publications from the tray 4.

Finally, this latter can present an element 50 projecting perpendicularly from its lower face 4K to act as a leg separator to adequately retain the child on the seat 3 and prevent it sliding below the tray 4. The element 50, having a free end 51 which is positioned close to the seat 3 when the tray 4 is in its position of use, can either be integral with the tray 4 or be a part separate from it and be fixed by fixing means such as screws or the like.

A specific embodiment of the invention has been described. Others are however possible (such as one in which the element 8 provided with handles covers only the surface 7 of the tray 45 and can be devised by an expert of the art on the basis of the preceding description and the accompanying claims.

What is claimed is:

1. A high-chair (1) having a seat (3), a frame (2) and a tray (4) associated with the seat (3) or the frame (2), said tray (4) presenting a perimetral edge (6) and a surface (7) bounded by said edge, said high-chair comprising:

a cover element (8) removably associable with said tray (4), said cover element (8) having a shape complementary to said tray (4) and arranged to cover at least the surface (7) of said tray (4), said cover element (8) being able to support containers of liquids and foods to be administered to a child seated on the seat (3) of the high-chair (1);

said cover element (8) having at least one hooking member (14) structured and arranged to cooperate with a counter-member (15) associated with the tray in such a manner as to secure said cover element (8) to said tray;

wherein the hooking member (14) comprises:

a slider (17) having one end (18) arranged to cooperate with a seat (19) provided in the tray (4), said slider (17) being associated with an operating slide button (21) slidable on that portion (20) of the cover element (8) containing said slider (17) and from which the end (18) of said slider (17) projects, wherein the slider (17) cooperates with a counteracting spring (23) during a controlled movement of said slide button (21), and a locking member (27) being associated with said portion (20) of the cover element (8) to prevent undesired movement of the slide button (21) and of the slider (17).

2. A high-chair as claimed in claim 1, wherein the cover element (8) is transparent and allows visual access to the underlying tray (4).

3. A high-chair as claimed in claim 1, wherein the cover element (8) comprises:

gripping members (13) for handling of said cover element (8).

4. A high-chair as claimed in claim 1, wherein the hooking member (14) is located in a position corresponding with one of said gripping members (13) of the cover element (8).

5. A high-chair as claimed in claim 1, wherein the locking member (27) comprises:

a body movable in a direction perpendicular to the direction of the slide button (21) of the hooking member (14), wherein a movement of said body takes place against a spring (28) contained within that portion (20) of the cover element (8) with which said hooking member (14) is associated, said body presenting a perimetral slot (30) enabling said slide button to move when said body is pressed against said spring (28).

6. A high-chair as claimed in claim 5, wherein the slide button (21) of the hooking member (14) has a curved edge (26) which cooperates with the body of the locking member (27) when the slide button (21) is prevented from moving.

7. A high-chair as claimed in claim 1, wherein the cover element (8) covers the entire tray (4), and wherein the seat (19) defining the counter-member (15) is present in the edge (6) of the tray (4).

8. A high-chair as claimed in claim 1, wherein the tray (4) supports removable elements (41), said removable elements (4 1) being able to be inserted into seats (40) in the surface (7) of the tray, said elements being able to be differently combined to define different figures.

9. A high-chair as claimed in claim 1, further comprising:

an element acting as a leg separator (50) coupled to a face (4K) opposite to the face coverable by said cover element (8).

10. A high-chair as claimed in claim 9, wherein the element acting as a leg separator (50) is integral with the tray.

* * * * *

UNITED STATES PATENT AND TRADEMARK OFFICE

CERTIFICATE OF CORRECTION

PATENT NO. : 6,497,452 B2
DATED : December 24, 2002
INVENTOR(S) : Catelli

It is certified that error appears in the above-identified patent and that said Letters Patent is hereby corrected as shown below:

Title page,
Item [30], should read -- MI2000 U 000661 --

Signed and Sealed this

Twenty-second Day of April, 2003

JAMES E. ROGAN
*Director of the United States Patent and Trademark Office*